United States Patent [19]

DeHaitre

[11] Patent Number: 4,639,566

[45] **Date of Patent: * Jan. 27, 1987**

[54] DIP SWITCH ASSEMBLY HAVING SIDE EXTENDING LEADS

[75] Inventor: Lon DeHaitre, Arlington Heights, Ill.

[73] Assignee: Abbott-Interfast Corporation, Wheeling, Ill.

[ * ] Notice: The portion of the term of this patent subsequent to Sep. 6, 2000 has been disclaimed.

[21] Appl. No.: 719,919

[22] Filed: Apr. 4, 1985

Related U.S. Application Data

[63] Continuation-in-part of Ser. No. 686,290, Dec. 26, 1984, abandoned, which is a continuation of Ser. No. 484,896, Apr. 14, 1983, abandoned, which is a continuation-in-part of Ser. No. 331,235, Dec. 16, 1981, Pat. No. 4,403,126.

[51] Int. Cl.[4] ..... H01B 3/40; H01H 1/02; H01R 9/00

[52] U.S. Cl. ..... 200/158; 200/16 R; 200/243

[58] Field of Search ..... 200/11 R, 16 R, 6 R, 200/6 B, 6 BB, 16 C, 16 D, 16 F, 138, 243; 361/397, 400, 403, 404, 405, 408, 417

[56] References Cited

U.S. PATENT DOCUMENTS

| | | | |
|---|---|---|---|
| 2,854,552 | 9/1958 | Gouverneur, II | 200/158 |
| 3,001,104 | 9/1961 | Brown, Jr. | 361/405 |
| 3,486,224 | 12/1969 | Chaney | 361/405 X |
| 3,626,086 | 12/1971 | Rubey | 361/405 X |
| 4,004,119 | 1/1977 | Latour | 200/158 |
| 4,027,128 | 5/1977 | Walker | 200/158 |
| 4,242,719 | 12/1980 | Conley | 361/405 X |
| 4,376,234 | 3/1983 | Liataud et al. | 200/16 D X |
| 4,403,126 | 9/1983 | DeHaitre | 200/16 R X |
| 4,531,030 | 7/1985 | Gingerich et al. | 200/6 R X |
| 4,541,034 | 9/1985 | Fanning | 361/405 |

*Primary Examiner*—J. R. Scott

*Attorney, Agent, or Firm*—Laff, Whitesel, Conte & Saret

[57] ABSTRACT

A miniature screw switch assembly is provided with side extending leads that are spaced apart at DIP standard distances. Each segment of the segmented body, which facilitates separation into individual switches, is molded around a pair of opposed, lead contact portions. A socket is provided in the segment between the contact portions for receiving a headed screw forming a bridging member between the two pole forming contact portions. Central portions of the leads extend substantially perpendicular from the body and segment sides and are bent downwardly at right angles to terminate in end portions. The end portions are intended to be inserted in through openings in printed circuit boards or surface-mounted on printed circuit boards. The disclosed assembly facilitates automatic manufacture, carrying to circuit board assembliers and insertion or surface-mounting on circuit boards.

12 Claims, 8 Drawing Figures

FIG. 1
PRIOR ART
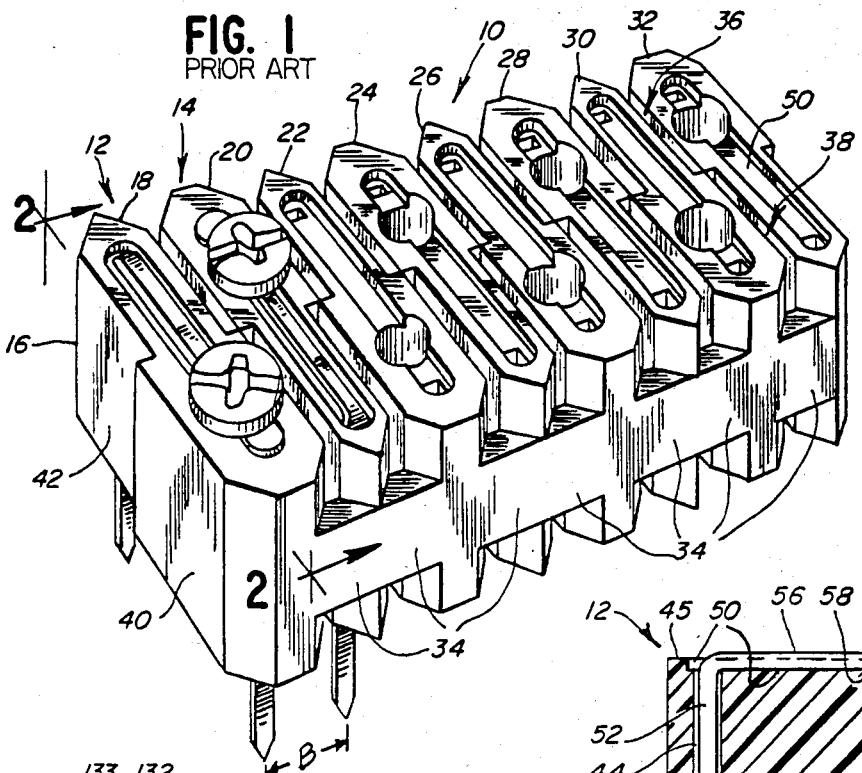
FIG. 2
PRIOR ART
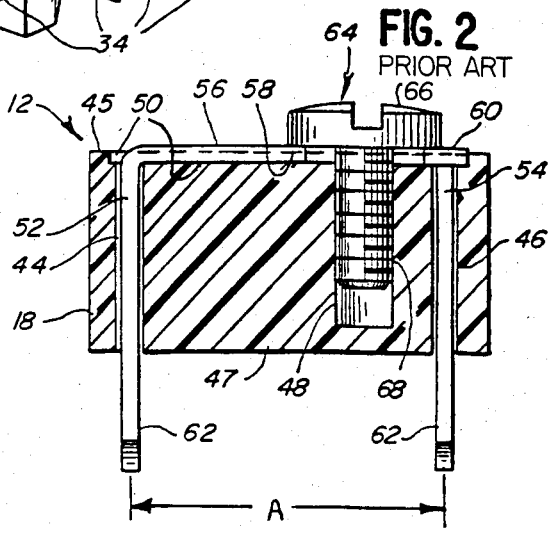
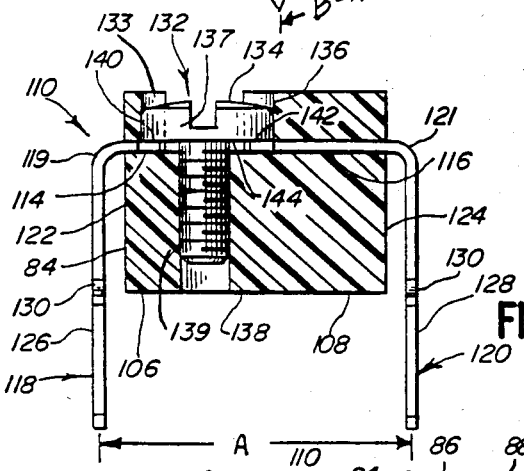
FIG. 4
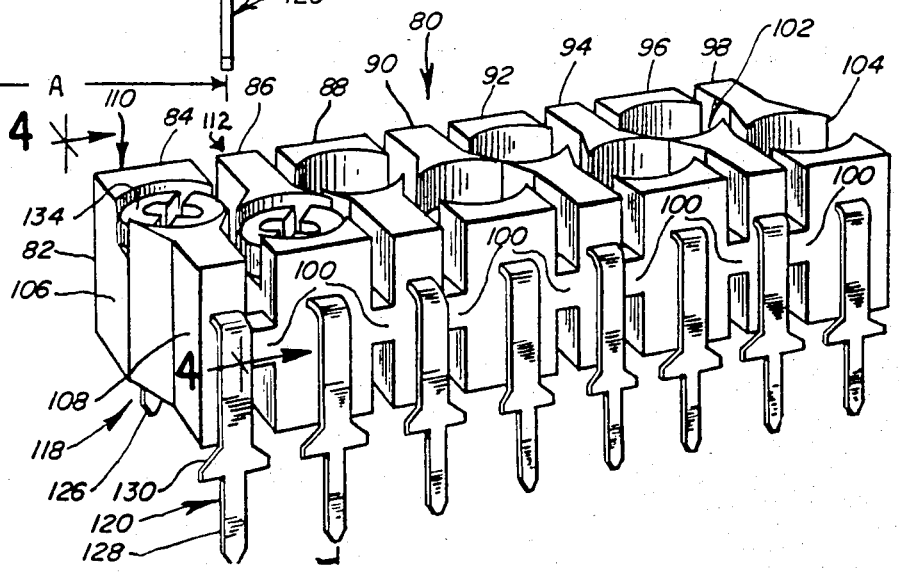
FIG. 3

FIG. 5
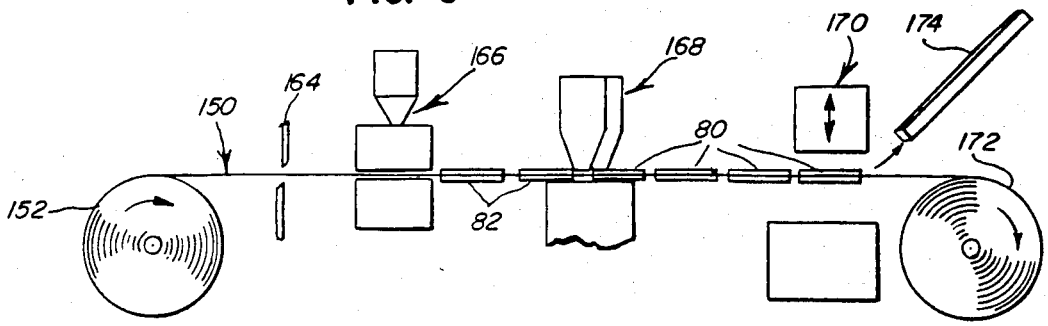
FIG. 6
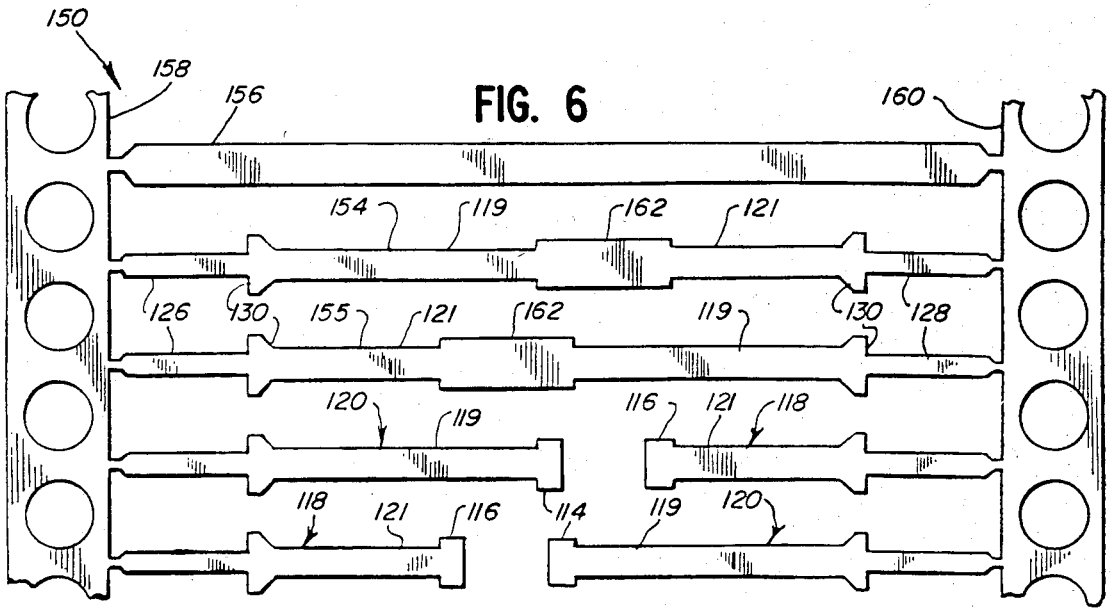
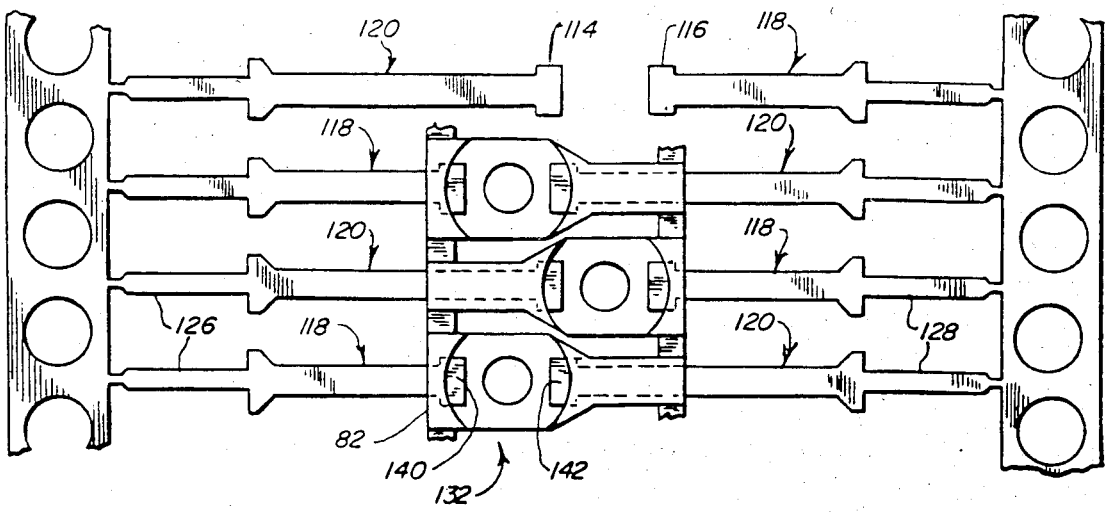
FIG. 7

DIP SWITCH ASSEMBLY HAVING SIDE EXTENDING LEADS

This application is a continuation-in-part of my co-pending application Ser. No. 686,290 filed Dec. 26, 1984, now abandoned, which in turn is a continuation of its co-pending application Ser. No. 484,896 filed Apr. 14, 1983, now abandoned, which in turn is a continuation-in-part of its co-pending application Ser. No. 331,235, filed Dec. 16, 1981, now issued as U.S. Pat. No. 4,403,126.

BACKGROUND OF THE INVENTION

This invention relates to electrical switches generally and, in particular, to miniature electrical switches used in electronic circuits comprising components that have their leads inserted into openings of printed circuit boards or surface-mounted on printed circuit boards by automatic equipment.

Modern electronic circuits that have elements mounted on printed circuit boards often provide switch selectable options to provide different functions. It has been desired to provide a miniature electrical switch assembly having leads that fit into the openings of a printed circuit board arranged at the same standard spacing used for integrated circuit packages, or which are surface-mountable on printed circuit boards. Such a switch assembly would use a minimum of circuit board area, which is a prime consideration in board lay-out and economics. The screw switch assembly of the above-mentioned application Ser. No. 331,235 filed Dec. 16, 1981, now issued as U.S. Pat. No. 4,403,126, provides a structure readily separable into individual screw switch segments. That structure presents superior contact qualities because of the provided screw wiping clean the two opposed leads contacts.

Previously, miniature switch assemblies were mounted on printed circuit boards manually. This occurred because of the large and non-uniform dimensions of the switch assemblies, i.e. it was not economical to build special machines for inserting the prior switch assemblies into printed circuit boards or surface-mounting them on printed circuit boards. Machines were and are available, however, and are widely used, for inserting the leads of components such as transistors, resistors, capacitors and integrated circuits into openings through printed circuit boards or for surface-mounting the components thereon. The use of such automatic insertion machines or surface-mounting equipment significantly has reduced the cost of inserting or surface-mounting such components on printed circuit boards. It therefore is desirable to provide a miniature switch structure that is readily machine insertable or surface-mountable on a printed circuit board.

The assembly or prior miniature switch assemblies usually involved a plurality of parts that had to be fitted together. For example, a slide or toggle switch assembly has spring and detent parts, in addition to the contacts, that are sandwiched between top and bottom covers. It would be highly advantageous, economically, to provide a miniature switch assembly that is manufactured, carried to printed circuit board manufacturers and inserted or surface-mounted with existing equipment in or on printed circuit boards automatically by machine and with a minimum of manual handling.

Prior miniature switch assemblies, however, while providing structures and configurations providing reasonable economic manufacture, carrying and insertion of contact leads into switch bodies, can be improved. For example, the referenced patent application Ser. No. 331,235 and U.S. Pat. No. 4,027,128 both disclose screw switch assemblies that have separate contact leads that typically are press fit through vertical openings of a molded body. This requires a manual or an additional machine operation to insert the contact leads. Machine insertion is not readily possible with existing equipment and is essentially a manual operation. Slide and toggle switch assemblies present the same or increased manual or machine operations in manufacture, carrying and insertion.

SUMMARY OF THE INVENTION

A miniature screw switch assembly has a body molded about a planar set of leads extending inwardly towards one another in pairs from a frame. The body comprises a plurality of side by side arranged separated segments joined together by readily separable webs extending between the ends of the segments at the lateral margins of the body. Each segment partially encloses an opposed pair of leads and presents a socket between proximate contact portions of the leads for receiving a contact making and breaking screw or like member.

The leads are fixed in the top half of the segments and have central portions and solderable end portions extending perpendicularly from the sides of the segments while the lead contact portions are open to or communicating with the screw receiving socket. After the body is molded about the leads, the lead end portions are bent downward so that the lead end portions may be inserted in the through openings in a printed circuit board, or they are bent downward and then horizontally so that the lead end portions may be surface-mounted on circuit boards. The body segments and leads are dimensioned so that the lead end portions fit into circuit board openings or match up with solder pads occurring at standard distances for integrated circuits. The screw switch assembly is dimensioned the same as an integrated circuit package and thus is able to be carried and inserted into boards or surface-mounted on boards by existing equipment.

The process for making the screw switch assembly is completely automatable to obviate manual intervention after set up. A web of lead frame material that has been cut in a stamping or rolling machine to form lead blanks and cross ties extending between two opposed, parallel carrier strips, is fed from a reel or spool to a stamping or rolling machine to form a pair of opposed leads from each lead blank. The lead pairs then are separated from one another at their contact portions but remain attached to their respective carrier strips. The cross ties occur at regular intervals along the web and maintain the spacing of the carrier strips after formation of the separated lead pairs. The web then is fed through a molding station or machine at which the body segments and webs are formed about the lead pairs and between the cross ties. The web then is fed through a screw insertion station or machine and then through another stamping machine that cuts the leads from the carrier strips and bends the lead end portions. The completed screw switch assemblies then are slipped into carrier tubes for delivery to circuit board manufacturers who insert or mount the assemblies on circuit boards using existing integrated circuit package insertion or mounting apparatus.

Alternatively, the web of lead frame material is cut to form only lead blanks extending between the two carrier strips. After the lead blanks are cut to form the pairs of opposed leads, the leads are located in an insert mold with the mold then positioning the leads one relative to the other. The rest of the steps then continue as described.

BRIEF DESCRIPTION OF THE DRAWING

FIG. 1 is a perspective view of a prior screw switch assembly;

FIG. 2 is a side sectional view of the assembly of Figure 1 taken along the lines 2—2 and in the direction indicated;

FIG. 3 is a perspective view of a screw switch assembly constructed and arranged in accordance with the invention;

FIG. 4 is a side sectional view of the assembly of Figure 3 taken along the lines 3—3 and in the direction taken;

FIG. 5 is a schematic diagram of the stations or apparatus used in the process of making the assembly of FIGS. 3 and 4;

FIG. 6 is a plan view of a portion of the web of strip material prior to molding of the body;

FIG. 7 is a plan view of a portion of the web after molding of the body and

DESCRIPTION OF THE PREFERRED EMBODIMENT

Figure 8:
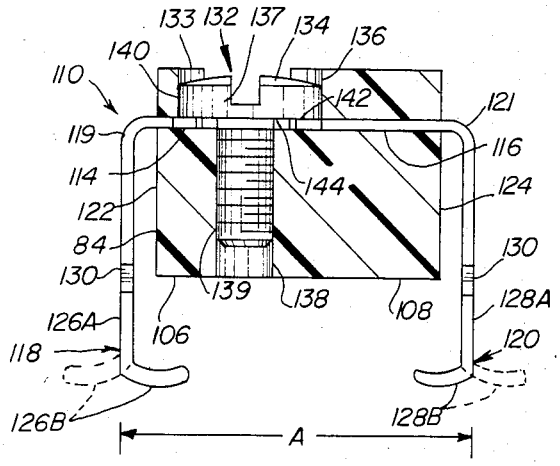
FIG. 8 is a view, similar to FIG. 4, of an alternative embodiment of a screw switch assembly constructed and arranged in accordance with the invention. It differs from the embodiments of the other Figures in only one respect: the embodiment of FIG. 8 is suitable for surface-mounting on a printed circuit board, while the embodiment of FIGS. 1–7 is suitable for insertion mounting on a printed circuit board.

In FIGS. 1 and 2, a known miniature screw switch assembly 10 provides eight individual switches of which only two switches 12 and 14 ar shown fully assembled. Assembly 10 comprises a body 16 providing a strip of eight individual segments 18 through 32, integrally molded together by the intermediaries of readily separable, thin, connecting webs 34. The segments 18–32 are arranged in side-by-side alignment and are separated from one another by alternating voids such as at 36 and 38 and thus, the only structure joining the segments together is the connecting webs. Connecting webs 34 are formed so that there are two such webs between each pair of adjacent segments, one at either end of the segments. Each segment includes a thick portion 40 and a thin portion 42 arranged to be in alternating position in sequential segments. The body 16 is formed by precision injection molding of an insulative thermo-plastic material.

Each switch of the assembly 10 is comprised of one segment, one screw, one bent stake and one headed stake.

Each segment is provided with two vertically extending and parallel passageways 44 and 46 extending from the top surface 45 to the bottom surface 47 of the segment. The passageways are at opposite ends of each segment and are arranged substantially in two rows along the strip. The passageways in each segment are spaced apart by a distance A (FIG. 2), which is approximately 0.300 inches; while the passageways in adjacent segments are spaced apart by a distance B (FIG. 1) of approximately 0.100 inches. These distances are the standard distances for spacings between leads of integrated circuits.

The segments additionally are provided, at their thick portions 40, with vertically extending sockets 48. The sockets 48 are open at least to the top of each segment and are arranged adjacent alternating ones of the passageways in adjacent segments. Each segment additionally is provided with a slot 50 in the top thereof. The slot 50 extends from beyond passageway 44 to beyond passageway 46.

One bent stake 52 and one headed staked 54 are inserted, respectively, into the passageways 44 and 46. The stakes 52 and 54 include respective top and bottom portions which extend beyond the respective top and bottom surfaces 45 and 47 of the segments. The stakes 52 and 54 are formed of lengths of 0.025 inch square, tinned, bronzed stock or its equivalent.

The top portion 56 (FIG. 2) of bent stake 52 is bent over at an angle of about 90° to the remainder of the stake and is received in slot 50 to provide a free end or top margin 58 spaced adjacent the opening 48. Top margin 58 provides an electrical contact surface above the plane of segment top surface 45. The top portion 60 of headed stake 54 provides a head having a diameter greater than the passageway 46. The headed top portion 60 is received in the slot 50 adjacent the socket 48, with the top surface of headed top portion 60 providing an electrical contact surface, also above the plane of segment top surface 45. The bottom portions 62 of the stake 52 and 54 are essentially identical and are cut to provide sixty degree points for ease of insertion of the stakes into perforations or openings in a printed circuit board.

Each assembled switch further includes a screw 64 having a head 66 and an externally threaded shaft 68, with the shaft 68 being threadedly received in socket 48. Screw 64 is a high performance screw such as a No. 1 by 0.160 inch, type "B", tinned, self-tapping, steel screw. Head 66 provides for either a slotted or combination slotted and Phillips drive. Screw 64 is rotatable only under intentional, positive, rotative action between an engaged position in which the bottom surface of the screw head engages against the top portions 56 and 60 of stakes 52 and 54, respectively, so as to make electrical contact between the stakes through the screw head, and a disengaged position in which the screw head is rotated free of the stakes to open electrical contact between the stakes. The stakes thus form poles of the switch and the screw head forms the bridging contact member.

The external threads of shaft 68 cut or form mating threads in the wall of socket 48. The material of body 16 tightly engages the threads of screw 64 so that screw 64 is positively maintained in its last operative position, whatever that may be, in spite of vibrational forces.

When the screw 64 is in the engaged position making contact between the stakes, the top portions of the stakes are clamped between the underside of the screw head 66 and the top of the segment. This clamping force may be as great as desired and is under control of the operator placing the screw in such operative position. This clamping force can be important in preventing contamination of the electrical path formed between the screw head 66 and the top portions of the stakes, the tightly clamped parts effectively resisting the migration of contaminants therebetween. Moreover, because the screw head is rotated against the top portion of the stakes, there is a self-cleaning wiping action between the lower surface of the screw head and the contact surfaces of the stakes which breaks through any covering or removes any contaminants thereon to ensure a good electrical contact having a low resistance.

The assembly 10 further may be divided into blocks of smaller numbers of switches by cutting through the connecting webs 34 between segments such as 22 and 24, in any manner desired such as with a tool known as side cutters. This separates the body 10 into blocks of the desired numbers of switches.

The body 16 is injected molded in long strips having as many as 100 individual segments. The bent and headed stakes are formed automatically on bandoliers and inserted into the passageways, in mass. Formation of the stakes on bandoliers facilitates selective plating, with precious metals such as gold, of only the contact surfaces of the top portions or top margins. Automatic machines are used for insertion of the screws in the openings 48.

Assembly 10 thus lends itself to manufacturing economy in that bodies one hundred segments in length can be molded at one time with the leads being inserted in mass from bandoliers. Better economy in manufacture is possible, however, with a switch assembly structure that is formed integrally with the leads, obviating the lead insertion step. Further economies are attainable during carrying or delivery to the manufacturer and during insertion into boards.

The major limitation to use of existing automatic insertion or surface-mounting equipment for inserting or surface-mounting miniature switch assemblies on boards is that existing switch assemblies have bottom extending leads. Present carrying systems and automatic insertion equipment are designed for components with side extending leads. Thus, a switch assembly structure that presented side extending leads could take advantage of present carrying systems and automatic insertion or surface-mounting equipment.

In accordance with the invention, there is illustrated in FIGS. 3 and 4 miniature screw switch assemblies 80 that provide for better economies in manufacture than previous assemblies and further provide for automatic carrying to board assemblers and insertion or surface-mounting on circuit boards by existing insertion or surface-mounting equipment.

Assembly 80 comprises a body 82 having eight side-by-side arranged, separated segments 84–98 joined together by readily separable webs 100 extending between the segments at the ends of the segments along the lateral margins of the body 82. The segments otherwise are separated from one another by such as voids 102 and 104. Each segment 84–98 has a thin portion 106 and a thin portion 108 that are arranged in staggered, alternating sequence along the length of body 82. Two fully assembled screw switch assemblies 110 and 112 are shown. Body 82 is formed of molded, electrically insulative, plastic material.

Contact portions 114 and 116 of a pair of separated, opposed leads 118 and 120 are integrally molded in the material of the body segments such as 84. Leads 118 and 120 have central portions 119 and 121 that extend perpendicularly from the sides 122 and 124 of segment 84, and then are bent downwards at about a ninety degree angle and terminate with solderable vertical end portions 126, 128. End portions 126, 128 are the portions of the leads that are inserted through openings in printed circuit boards for mounting and soldering thereon. Leads 118 and 120 further provide protuberances, such as 130, which engage the circuit board peripherally of the through openings for suspending the body segments above the top surface of the circuit board.

The thick portion 106 of every segment is formed to present a socket 132 extending downwardly into said body from a top side 133 for receiving a headed screw 134 or like member. Socket 132 provides a mouth 136 for receiving the screw head 137 and a vertically descending shaft 138 for receiving the threaded screw shaft 139. Screw 134 is of the self-threading type that forms mating threads in the wall of shaft 138 when driven therein. Screw 134 typically is a number "0" screw having a head receiving either a slot or Philips point screw driver. Mouth 136 and head 137 are dimensioned so that head 137 is entirely accommodated in mouth 136 below top side 133. This avoids head 137 interfering with automatic handling equipment.

Contact portions 114 and 116 of leads 118 and 120 have contact areas 140 and 142 that are open to communicate with the mouth 136 of socket 132 and engage the bottom surface 144 of the screw head 137 when screw 134 is rotated downwardly to the limit of its travel in socket 132. Contact areas 140, 142 are free of flash that otherwise could occur during molding of body 82. Contact surfaces 140, 142 determine the downward limit of travel of screw 134.

Screw head 137 thus forms the bridging member between the poles of the switch formed by contact areas 140, 142 of contact portions 114, 116. Rotating the screw 134 upwardly disengages the bottom surface 144 of the screw head from contact areas 140, 142 and opens the switch. Rotating the screw downwardly to the limit of its travel closes the switch. The rotation of the screw head 137 across the contact areas causes a wiping action that cleans the contact areas of contaminants and results in a better electrical path for low level logic signals typically carried by a miniature switch. Contact areas 140, 142 and bottom surface 144 may be selectively plated, inlaid or clad as desired to obtain better electrical conduction qualities.

The distance "A" between the lead end portions in one segment is again the standard 0.300 inches while the distance "B" between lead end portions in adjacent segments is the standard 0.100 inches.

The webs 100 provide for separation of body 82 into blocks of desired numbers of screw switches, like in the assembly 10 of FIGS. 1 and 2.

The structure of assembly 80 lends itself readily to automatic manufacture, carrying to the board manufacturer and insertion into circuit boards with exceptional economy. Referring to FIGS. 5, 6 and 7, a web 150 of lead frame material is fed from a spool 152 to the several manufacturing stations or machines for producing assembly 80. Web 150, in the form supplied from reel 152, is an elongate strip of conductive material that has been cut by stamping or rolling to form lead blanks 154, 155 and cross ties 156 that extend between two opposed, parallel carrier strips 158, 160. Typically, there will be eight lead blanks between every two carrier strips, because typically the bodies 82 will each comprise eight lead containing segments.

Cross ties 156 are uniformly dimensioned portions of the web material that will remain attached to the carrier strips 158, 160 through and after making of assemblies such as 82. They provide dimensional stability for the carrier strips and leads during further processing of the lead blanks.

Each lead blank 154, 155 provides an integral contact pad 162, central portions 119, 121, protuberances 130 and end portions 126, 128. Contact pads 162 in blanks 154, 155, and so on are staggered, alternately closer to one and the other of carrier strips 158 and 160. Contact pads 162 will be cut through to form the separated contact portions 114, 116 referred to earlier.

Web 150 is fed from spool 152 through a cutting station, machine or apparatus 164 that divides the lead blanks in approximately half by cutting through the contact pad 162, to form the two leads 118, 120 and the contact portions 114 and 116. The leads 118, 120 remain attached to the carrier strips 158, 160, and the cross ties are unaffected. This operation conceivably can be performed prior to the web 150 being wound upon spool 152, but it is preferred to be performed upon the web being supplied from the spool better to maintain the dimensional stability between the contact portions.

Web 150 then passes through a precision injection molding machine 166 where the body 82 is molded around the leads 118, 120. Lead contact areas 140, 142 are open to the mouth 136 of socket 132 and are free of flash from the molding operation. The body 82 is carried on the web by the leads 118, 120 that remain attached to the carrier strips.

Bodies 82 then are carried through an automatic screw insertion machine 168 that insert the screws 134 in the sockets 132. Thereafter, the assemblies 80 are carried by the web through a severing and forming station or machine 170 where the leads 118, 120 are separated by cutting from the carrier strips 158, 160 and the central portions 119, 121 are bent down to present the end portions 118, 120 at the desired angle. The web 150, now comprising the carrier strips and cross ties, is wound up on a spool 172 while the completed switch assemblies 80 are automatically slipped into a carrier tube 174.

The switch assemblies 82 are delivered to board manufacturers or assemblers in the carrier tubes 174. The board manufacturers or assemblers feed the switch assemblies 82 directly from the carrier tubes 174 to the existing automatic insertion equipment used for inserting integrated circuit packages realizing maximum economic benefit.

The body 82 of assembly 80 has exterior dimensions approximating the typical dimension of the dual in-line package (DIP) used for 16 and 18 pin integrated circuits. This results because the body 82 must accommodate and facilitate the lead end portions being spaced apart at distances standardized for integrated circuit DIPs. The dimensions standardized for larger DIP packages could be used but require greater circuit board area than is necessary.

By providing a miniature screw switch assembly having side extending leads, substantial savings and simplicity are achieved in the manufacture of the assembly. This assembly achieves further savings by its ability to be automatically handled in delivery to board assemblers and in insertion of circuit boards.

Alternatively, the assembly 80 may be manufactured with the web 150 of lead material being free of connecting cross ties 156. In this case the dimensional stability between the two opposed sets of leads carried by each carrier strip is provided by the mold, such as an inset mold.

Additionally, the assemblies may be subjected to a stamping/printing operation prior to loading in the tube carriers to impress the company mark or name, switch position, etc. on the leads or body.

The embodiment of FIG. 8 is the same in all respects as that just described, except that the vertical end portions 126A and 128A of the leads 118 and 120 respectively end in horizontally bent legs 126B and 128B respectively which are suitable for surface-mounting on a printed circuit board instead of insertion mounting. The horizontal legs can be bent either inwardly (solid lines) or outwardly (broken lines).

The invention may be practiced other than as specifically described in the preferred embodiment disclosed herein. The switch body may be formed of fewer or more segments. The lead blanks and leads may have different configurations and may be located at a different level in the switch body. It will be understood that the lead blanks, cross-ties and leads illustrated in FIGS. 6 and 7 are illustrative only and do not limit the invention to any particular number of lead blanks, cross-ties or leads per assembly.

I claim:

1. A switch assembly comprising:

a body of electrically insulative material molded to provide a strip of integrally formed, joined segments arranged in side-by-side alignment, each segment having a top surface, a bottom surface, lateral side surfaces, and two opposed ends;

each segment presenting a pair of horizontally extending passageways opening to said side surfaces, and each segment presenting a vertical socket open to the top surface, the sockets of respective segments being arranged adjacent alternating ends of said adjacent segments, the passageways in adjacent segments being spaced apart at a standard distance;

a pair of conductive stakes in each segment, one stake being inserted in each passageway of each said segment and each stake presenting a top contact portion formed to be adjacent to and spaced from the socket of that segment to form a pole of a switch so that the top portions of the two stakes inserted in the two passageways of each segment form two spaced poles of a switch;

each segment having a headed screw inserted in said socket and forming a bridging member extending between said two poles, said screw capable of being rotated between an engaged position in which the screw head makes electrical contact between the poles of said segment to close the switch of that segment and a disengaged position in which the screw head is free of said poles to open the switch of that segment;

there being connecting webs between every pair of adjacent segments formed about the median horizontal plane of the segments, the connecting webs having a height less than the distance between the segment top and bottom surfaces and a width much less than the distance between the segment ends;

each said pair of stakes forming a pair of opposed leads having said contact portions thereof integrally molded in said body, and central portions that extend substantially perpendicularly out of said body respectively at said two sides of the body and that are bent downwardly at approximately right angles to said contact portions, and each of said leads having end portions terminating said leads opposite said contact portions, the distance between lead end portions of adjacent pairs of leads being a standard distance, and the distance between lead end portions of each pair of leads also being a standard distance.

2. The assembly of claim 1 in which each of the sockets presents, in a vertically descending order, a mouth and a socket shaft, the mouth receiving the screw head and the socket shaft receiving the screw shaft.

3. The assembly of claim 2 in which the mouth entirely accommodates the screw head below the body top surface.

4. A dual-inline-package switch assembly comprising:

(a) a unitary body of electrically insulative material comprised of a plurality of spaced apart, like segments including separable means only joining the segments one to another in side-by-side alignment, and each segment having a top surface, lateral sides, and two opposed ends;

(b) a pair of conductive members in each segment having connection ends extending beyond the segment connectably to a circuit and contact ends opposite said connection ends spaced one from the other to form two poles of a switch;

(c) each segment having a vertical socket opening to said top surface;

(d) an electrically conductive fastener having a threaded shank engaged in said socket and having a head selectively movable into and out of engagement with said contact ends for closing and opening an electrical circuit respectively;

(e) there being such separable means joining each pair of side-by-side segments, said means being located adjacent the said ends and corstructed and arranged to enable selective separation of the unitary body into individual blocks of any desired number of segments;

(f) each said pair of conductive members forming a pair of opposed leads having said contact ends thereof integrally molded in said body, and central portions that extend perpendicularly out of said body respectively at said two sides of the body and that are bent downwardly at approximately right angles to said contact portions, and each of said leads having end portions terminating said leads opposite said contact portions, the distance between said end portions of adjacent pairs of leads being a standard distance, and the distance between said end portions of each pair of leads also being a standard distance.

5. A dual-inline-package switch assembly comprising:

(a) a unitary body of electrically insulative material providing a plurality of spaced apart, like segments joined together as an elongated strip in side-by-side alignment, each segment presenting thin and thick portions alternately arranged in sequential segments, each segment having a top surface, lateral side surfaces, and two opposed ends:

(b) a pair of conductive members in each segment, the members having connection ends extending beyond the segment connectable to a circuit and having contact ends opposite said connection ends spaced one from another to form two poles of a switch;

(c) each segment presenting a vertical socket in said thick portion opening to the top surface;

(d) a screw inserted in said socket and having a head forming a bridging member movable relative to said contact ends for selectively opening and closing an electrical circuit between said pair of members of the associated segment;

(e) each said pair of conductive members forming a pair of opposed leads having said contact ends thereof integrally molded in said body, and central portions that extend perpendicularly out of said body respectively at said two sides of the body and that are bent downwardly at approximately right angles to said contact portions, and each of said leads having end portions terminating said leads opposite said contact portions, the distance between said end portions of adjacent pairs of leads being a standard distance, and the distance between said end portions of each pair of leads also being a standard distance.

6. A switch assembly comprising:

a body of electrically insulative material molded to provide a strip of integrally formed joined segments arranged in side-by-side alignment, each segment having a top surface, a bottom surface, lateral sides surfaces, and two opposed ends;

each segment presenting a pair of horizontally extending passageways opening to said side surfaces, and each segment presenting a vertical socket open to the top surface, the sockets of respective segments being arranged adjacent alternating ends of said adjacent segments, the passageways in adjacent segments being spaced apart at a standard distance;

a pair of conductive stakes in each segment, one stake being inserted in each passageway of each said segment and each stake presenting a top contact portion formed to be adjacent to and spaced from the socket of that segment to form a pole of a switch so that the top portions of the two stakes inserted in the two passageways of each segment form two spaced poles of a switch;

each segment having a headed screw inserted in said socket and forming a bridging member extending between said two poles, said screw rotatable between an engaged position in which the screw head makes electrical contact between the poles of said segment to close the switch of that segment and a disengaged position in which the screw head is free of said poles to open the switch of that segment;

each segment being formed to provide a thin portion and a thick portion, the thin and thick portions being alternately arranged in adjacent segments and said thick portions being provided with said sockets;

each said pair of stakes forming a pair of opposed leads having said contact portions thereof integrally molded in said body, and central portions that extend perpendicularly out of said body respectively at said two sides of the body and that are bent downwardly at approximately right angles to said contact portions, and each of said leads having end portions terminating said leads opposite said contact portions, the distance between said end portions of adjacent pairs of leads being a standard distance, and the distance between said end portions of each pair of leads also being a standard distance.

7. A switch assembly comprising:

a body of electrically insulative material molded to provide a strip of integrally formed, joined segments arranged in side-by-side alignment, each segment having a top surface, a bottom surface, lateral side surfaces, and two opposed ends;

each segment presenting a pair of horizontally extending passageways opening to said side surfaces, and each segment presenting a vertical socket open to the top surface, the sockets of respective segments being arranged adjacent alternating ends of said adjacent segments, the passageways in adjacent segments being spaced apart at a standard distance;

a pair of conductive stakes in each segment, one stake being inserted in each passageway of each said segment and each stake presenting a top contact portion formed to be adjacent to and spaced from the socket of that segment to form a pole of a switch so that the top portions of the two stakes inserted in the two passageways of each segment form two spaced poles of a switch;

each segment having a headed screw inserted in said socket and forming a bridging member extending between said two poles, said screw rotatable between an engaged position in which the screw head makes electrical contact between the poles of said segment to close the switch of that segment and a disengaged position in which the screw head is free of said poles to open the switch of that segment;

there being connecting webs between every pair of adjacent segments formed about the median horizontal plane of the segments, the connecting webs having a height less than the distance between the segment top and bottom surfaces and a width much less than the distance between the segment ends;

each said pair of stakes forming a pair of opposed leads having said contact portions thereof integrally molded in said body, and central portions that extend substantially perpendicularly out of said body respectively at said two sides of the body and that are bent downwardly at approximately right angles to said contact portions, and each of said leads having end portions terminating said leads opposite said contact portions, each of said lead end portions having a vertical leg and terminating in a horizontal leg, the distance between said vertical legs of said lead end portions of adjacent pairs of leads being a standard distance, and the distance between said vertical legs of said lead end portions of each pair of leads also being a standard distance.

8. The assembly of claim 7 in which each of the sockets presents, in a vertically descending order a mouth and a socket shaft, the mouth receiving the screw head and the socket shaft receiving the screw shaft.

9. The assembly of claim 8 in which said mouth entirely accommodates said screw head below the body top surface.

10. A dual-inline-package switch assembly comprising:

(a) a unitary body of electrically insulative material comprised of a plurality of spaced apart, like segments including separable means only joining the segments one to another in side-by-side alignment, and each segment having a top surface, lateral sides, and two opposed ends;

(b) a pair of conductive members in each segment having connection ends extending beyond the segment connectable to a circuit and contact ends opposite said connection ends spaced one from the other to form two poles of a switch;

(c) each segment having a vertical socket opening to said top surface;

(d) an electrically conductive fastener having a threaded shank in said socket and having a head selectively moveable into and out of engagement with said contact ends for closing and opening an electrical circuit respectively;

(e) there being such separable means joining each pair of side-by-side segments, said means being located adjacent the said ends and constructed and arranged to enable selective separation of the unitary body into individual blocks of any desired number of segments;

(f) each said pair of conductive members forming a pair of opposed leads having said contact ends thereof integrally molded in said body, and central portions that extend perpendicularly out of said body respectively at said two sides of body, and that are bent downwardly at approximately right angles to said contact portions, and each of said leads having portions terminating said leads opposite said contact portions, each of said lead end portions having a vertical leg and terminating in horizontal leg, the distance between said vertical legs of said end portions of adjacent pairs of leads being a standard distance, and the distance between said vertical legs of said end portions of each pair of leads also being a standard distance.

11. A dual-inline-package switch assembly comprising:

(a) a unitary body of electrically insulative material providing a plurality of spaced apart, like segment joined together as an elongated strip in side-by-side alignment, each segment presenting thin and thick portions alternately arranged in sequential segments, each segment having a top surface, lateral side surface, and two opposed ends:

(b) a pair of conductive members in each segment, the members having connection ends extending beyond the segment connectable to a circuit and having contact ends opposite said connection ends spaced one from another to form two poles of a switch;

(c) each segment presenting a vertical socket in said thick portion opening to the top surface;

(d) a screw inserted in said socket and having a head forming a bridging member movable relative to said contact ends for selectively opening and closing an electrical circuit between said pair of members of the associated segment;

(e) each said pair of conductive members forming a pair of opposed leads having said contact ends thereof integrally molded in said body, and central portions that extend perpendicularly out of said body respectively at said two sides of the body and that are bent downwardly at approximately right angles to said contact portions, and each of said leads having end portions terminating said leads opposite said contact portions, each of said lead end portions having a vertical leg and terminating in a horizontal leg, the distance between said vertical legs of said end portions of adjacent pairs of leads being a standard distance, and the distance between said vertical legs of said end between said end portions of each pair of leads also being a standard distance.

12. A switch assembly comprising:

a body of electrically insulative material molded to provide a strip of integrally formed, joined segments arranged in side-by-side alignment, each segment having a top surface, a bottom surface, lateral side surfaces, and two opposed ends;

each segment presenting a pair of horizontally extending passageways opening to said side surfaces, and each segment presenting a vertical socket open to the top surface, the sockets of respective segments being arranged adjacent alternating ends of said adjacent segments, the passageways in adjacent segments being spaced apart at a standard distance;

a pair of conductive stakes in each segment, one stake being inserted in each passageway of each said segment and each . stake presenting a top contact portion formed to be adjacent to and spaced from the socket of that segment to form a pole of a switch so that the top portions of the two stakes inserted in the two passageways of each segment form two spaced poles of a switch;

each segment having a headed screw inserted in said socket and forming a bridging member extending between said two poles, said screw rotatable between an engaged position in which the screw head makes electrical contact between the poles of said segment to close the switch of that segment and a disengaged position in which the screw head is free of said poles to open the switch of that segment;

each segment being formed to provide a thin portion and a thick portion, the thin and thick portions being alternately arranged in adjacent segments and said thick portions being provided with said sockets;

each pair of stakes forming a pair of opposed leads having said contact portions thereof integrally molded in said body, and central portions that extend perpendicularly out of said body respectively at said two sides of the body and that are bent downwardly at approximately right angles to said contact positions, and each of said leads having end portions terminating said leads opposite said contact positions, each of said lead end portions having a vertical leg and terminating in a horizontal leg, the distance between said vertical legs of said end portions of adjacent pairs of leads being a standard distance, and the distance between said vertical legs of said end portions of each pair of leads also being a standard distance.

* * * * *